US005798789A

United States Patent [19]

Ono et al.

[11] Patent Number: 5,798,789

[45] Date of Patent: Aug. 25, 1998

[54] RECORDING METHOD AND APPARATUS WITH PREHEATING USING INVERTED IMAGE DATA

[75] Inventors: Takeshi Ono, Yokohama; Takehiro Yoshida, Tokyo; Makoto Kobayashi, Tama; Tomoyuki Takeda, Yokohama; Satoshi Wada, Kawasaki; Minoru Yokoyama; Takashi Awai, both of Yokohama; Yasushi Ishida, Tokyo; Akihiro Tomoda; Masakatsu Yamada, both of Yokohama, all of Japan

[73] Assignee: Canon Kabushiki Kaisha, Tokyo, Japan

[21] Appl. No.: 321,599

[22] Filed: Oct. 12, 1994

Related U.S. Application Data

[63] Continuation of Ser. No. 999,546, Dec. 31, 1992, abandoned, which is a continuation of Ser. No. 560,195, Jul. 31, 1990, abandoned.

[30] Foreign Application Priority Data

Jul. 31, 1989 [JP] Japan ..... 1-196782
Jul. 27, 1990 [JP] Japan ..... 2-198010

[51] Int. Cl.[6] ..... B41J 2/38; B41J 2/36; B41J 2/365

[52] U.S. Cl. ..... 347/186; 347/188

[58] Field of Search ..... 346/76 PH; 400/120, 400/120.08, 120.09, 120.18; 347/186, 188

[56] References Cited

U.S. PATENT DOCUMENTS

| | | | |
|---|---|---|---|
| 3,855,448 | 12/1974 | Hanagata et al. | 219/216 |
| 4,421,428 | 12/1983 | Noda et al. | 400/120 |
| 4,449,136 | 5/1984 | Moriguchi et al. | 346/76 PH |
| 4,449,137 | 5/1984 | Inui et al. | 346/76 PH |
| 4,456,392 | 6/1984 | Nozaki et al. | 400/120 |
| 4,510,507 | 4/1985 | Ishikawa | 346/76 PH |
| 4,531,133 | 7/1985 | Leng | 346/76 PH |
| 4,568,817 | 2/1986 | Leng et al. | 346/76 PH |
| 4,675,700 | 6/1987 | Nagira et al. | 346/76 PH |
| 4,724,447 | 2/1988 | Oda | 346/76 PH |
| 4,737,860 | 4/1988 | Ono et al. | 358/298 |
| 4,760,462 | 7/1988 | Ogawa | 346/76 PH |
| 4,814,789 | 3/1989 | Ono | 346/76 PH |
| 4,875,056 | 10/1989 | Ono | 346/76 PH |
| 4,896,167 | 1/1990 | Hayakawa | 346/76 PH |
| 4,963,884 | 10/1990 | Kiguchi et al. | 346/1.1 |
| 5,019,836 | 5/1991 | Iwata et al. | 346/76 PH |

FOREIGN PATENT DOCUMENTS

| | | | |
|---|---|---|---|
| 0095177 | 6/1984 | Japan . | |
| 095177 | 6/1984 | Japan . | |
| 0147359 | 8/1985 | Japan | 346/76 PH |
| 0049867 | 3/1986 | Japan . | |
| 0004970 | 1/1988 | Japan | 346/76 PH |
| 0051159 | 3/1988 | Japan | 346/76 PH |
| 0000539 | 1/1990 | Japan . | |

*Primary Examiner*—N. Le
*Assistant Examiner*—L. Anderson
*Attorney, Agent, or Firm*—Fitzpatrick, Cella, Harper & Scinto

[57] ABSTRACT

Thermal transfer recording apparatus for recording image on the recording medium by transferring ink of the ink sheet on the recording medium characterized by being provided with the ink sheet conveying means, the recording medium conveying means, recording means to record the image on the recording medium by being driven in accordance with the image data and working on the ink sheet and control means to drive the recording means with the energy smaller than that used at the time of ordinary recording utilizing the inverted data of the image data used in the preceding recording, the apparatus providing such advantage as the improvement of image quality, saving of consumption of ink sheet and saving of running cost, etc.

2 Claims, 11 Drawing Sheets

CONVEY RECORDING SHEET BY ONE LINE AND INK SHEET BY 1/n LINES
S27
PRINT (ENERGIZE BLOCK(S) OF HEAT GENERATING RESISTANCE FOR TIME t1)
S28
S29
TERMINATE PRINTING ?
NO
YES
W BUSY IS TURNED OFF
S30

RECORDING METHOD AND APPARATUS WITH PREHEATING USING INVERTED IMAGE DATA

This application is a continuation of application Ser. No. 07/999,546 filed Dec. 31, 1992, which is a continuation of application Ser. No. 07/560,195 filed Jul. 31, 1990 both abandoned.

BACKGROUND OF THE INVENTION

1. Field of the Invention

The present invention relates to a recording method and apparatus to record image on a recording medium.

Here, the recording apparatus includes those taking such form as, for example, facsimile, electronic typewriter, copying machine, printer, etc.

2. Related Background Art

Hereunder are explained the thermal transfer recording method and apparatus as the example of the recording method and apparatus, with reference to actual examples.

Generally speaking, a thermal transfer printer executes image recording by using an ink sheet obtained by coating hot-melt (or hot-sublimating etc.) ink on a base film, selectively heating such ink sheet with a thermal head according to the image signal and transferring the molten (or sublimated etc.) ink on the recording sheet. Generally speaking, the ink of such ink sheet is completely transferred to the recording sheet by one image recording (the so-called one-time sheet) and therefore it has been necessary to convey such ink sheet, after termination of recording for one character or one line, for a distance corresponding to the length of such recording so that an unused part of the ink sheet is brought to the position of the succeeding recording with certainly. As a result, the amount of ink sheet consumed increases and the running cost of thermal transfer printer tends to be higher than that of the ordinary heat-sensitive printer which records on the heat sensitive sheet.

In order to solve such problems, a thermal transfer printer wherein the recording sheet and ink sheet are conveyed at different speed has been proposed as observed in U.S. Pat. No. 4,456,392, Japanese Laid-Open Patent Applications Nos. 58-201686 and 62-58917. As described in these references, the ink sheet which enables image recording for plural number (n) of times (the so-called multi-print ink sheet) has been known and when such ink sheet is used, it is possible, in the continuous recording of recording length L, to record by making the conveying length of the ink sheet at the termination of recording of the image during recording of the image smaller than the length L(L/n:n>1). In this way, the efficiency of use of the ink sheet becomes n times larger than conventional case and savings of running costs of thermal transfer printer can be expected. Hereunder, such a recording system is called multi-print system.

In recording systems that execute recording with a head, there is a trend when a dark dot (the dot for recording) is recorded next to a white dot (the dot not for recording), the heat generating apparatus corresponding to the dot cools off and the printed dot becomes pale in shade.

History control may be exercised as a solution of such problem. However in the case of history control, energizing of the recording head for recording one line must be conducted dividedly for a plural number of times. Besides, the data corresponding to each of thus divided energizations must be transferred, and as a result, the circuit becomes complicated.

SUMMARY OF THE INVENTION

An objective of the present invention is to provide a recording method and apparatus which provides a recorded image having improved quality.

Another objective of the present invention is to provide a thermal transfer recording method and apparatus which enables reduction of ink sheet consumption.

Still another objective of the present invention is to provide a thermal transfer recording method and apparatus which enables the reduction of running costs.

Still another objective of the present invention is to provide a thermal transfer recording method and apparatus which enables to reproduction of an image of favorable quality being free from weakness of concentration (or fading) of independent black pixels, by a simple composition.

DETAILED DESCRIPTION OF THE PREFERRED EMBODIMENTS

Hereunder is explained in detail a preferred embodiment of the present invention with reference to the attached drawings.

The explanation shall be made taking a facsimile apparatus as the example of recording apparatus.

The embodiment to be explained hereunder concerns an apparatus which functions in such a way that prior to the ordinary recording of image by recording means the recording means is driven with an amount of energy smaller than that used in the ordinary recording, utilizing the inverted data of the image used in the preceding recording.

[Explanation of facsimile (FIGS. 1–4)].

Figure 1:
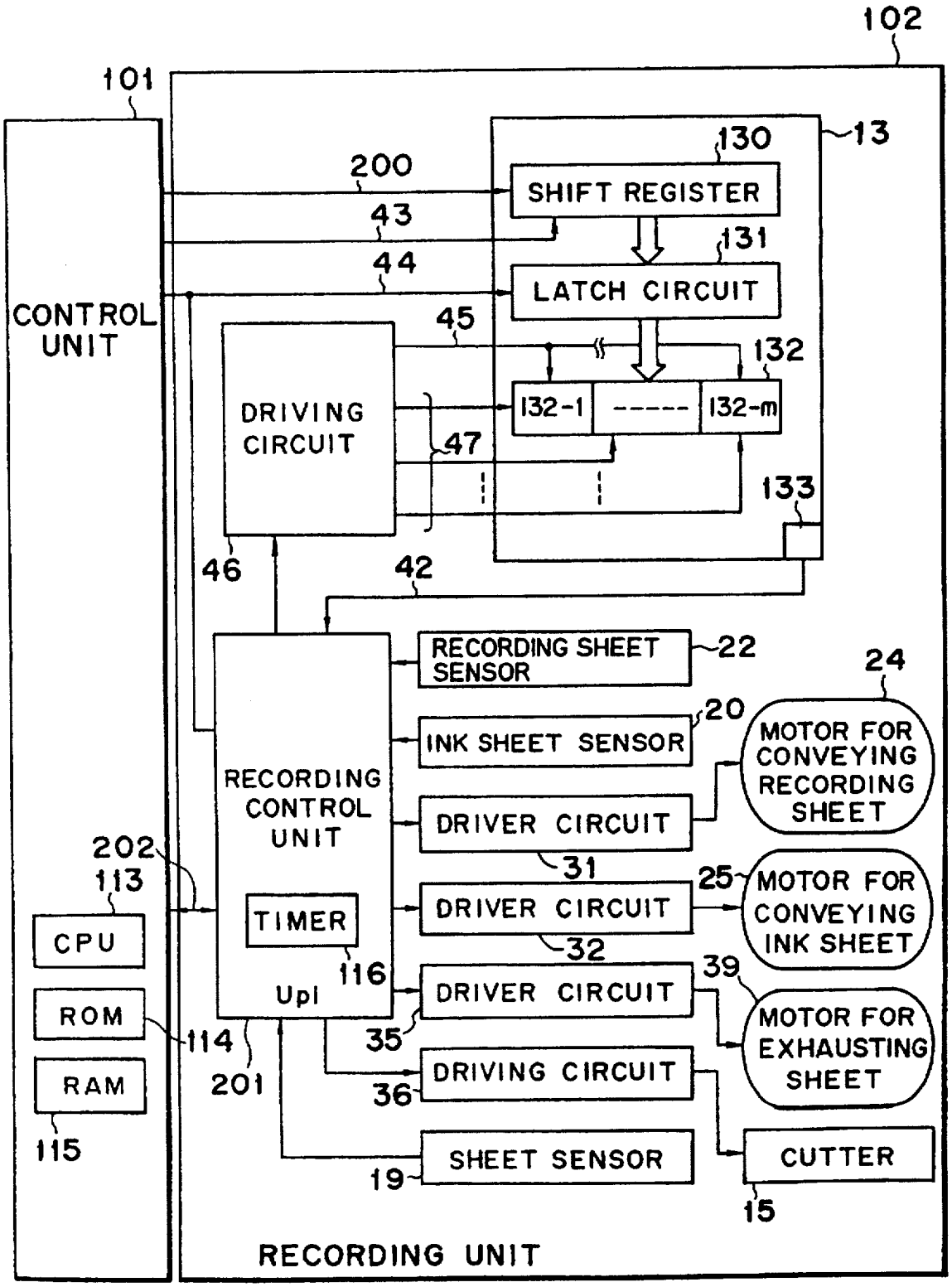
FIG. 1 is the drawing that illustrate the connection of control unit and recording unit of an embodiment of the present invention.
Figure 2:
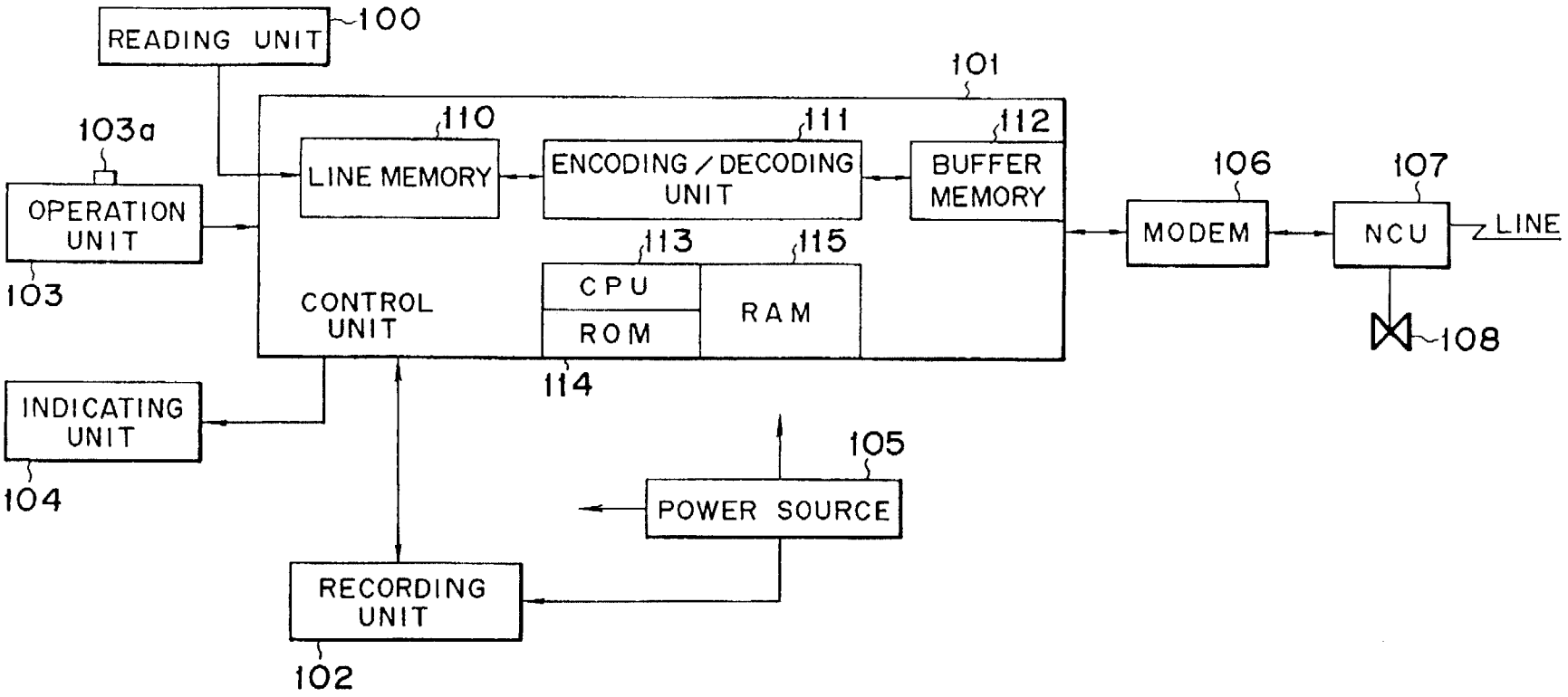
FIG. 2 is a block diagram showing the outline of construction of the facsimile apparatus of the aforesaid embodiment.
Figure 3A:
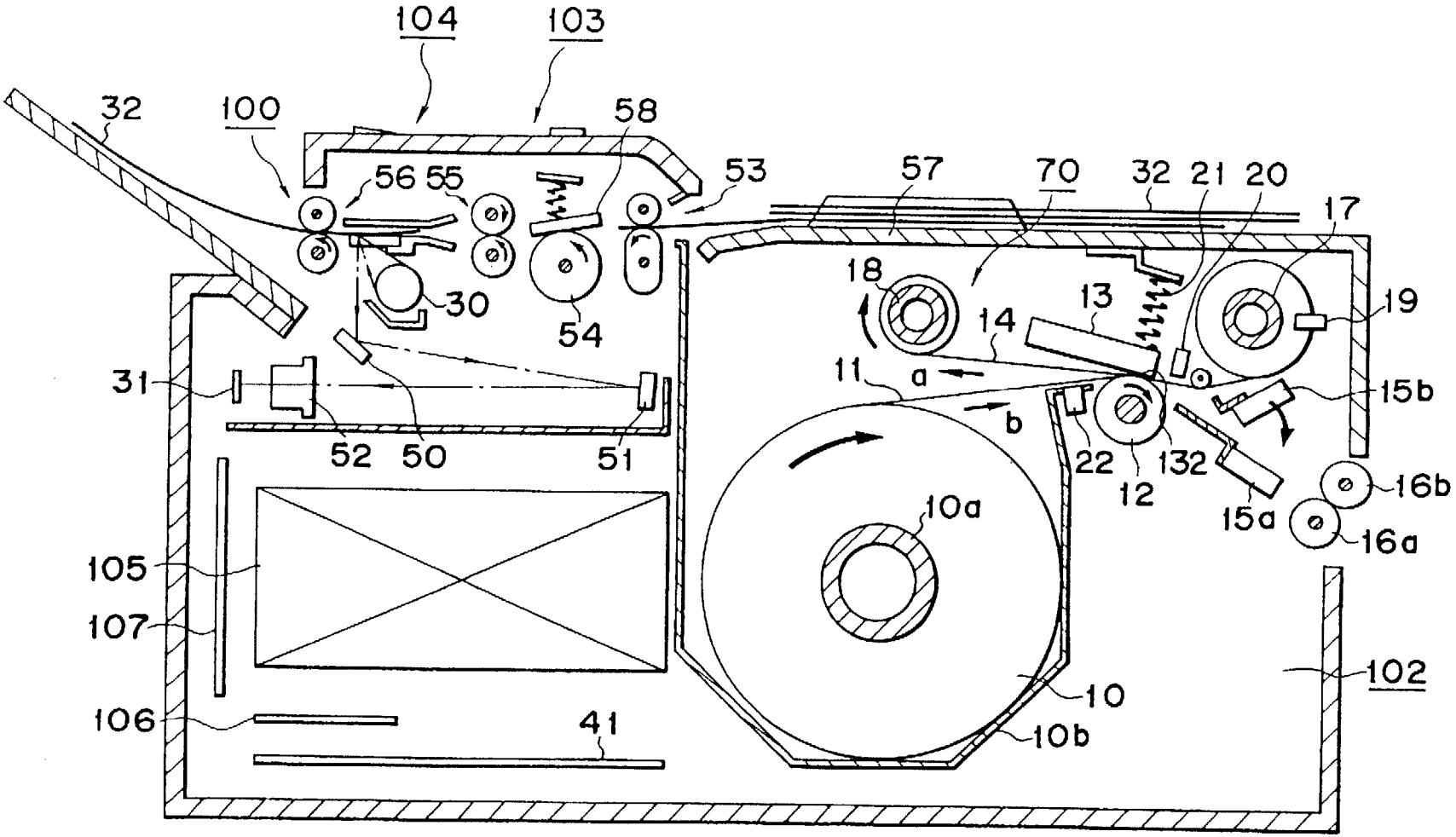
FIG. 3A is a side sectional view showing the structural unit of the facsimile of the aforesaid embodiment.
Figure 3B:
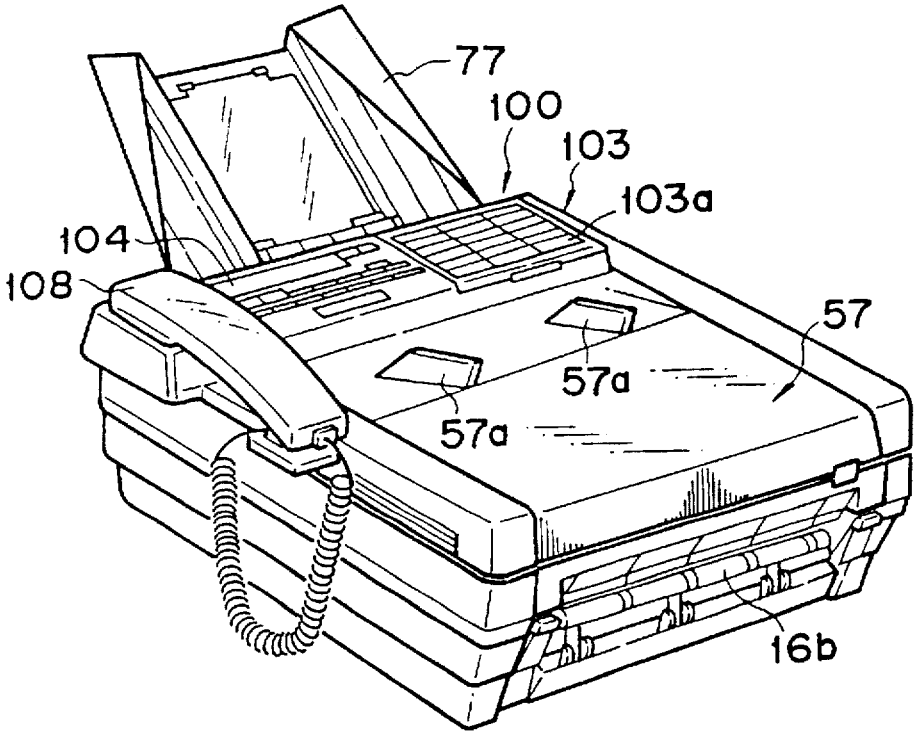
FIG. 3B is an external diagonal view of the facsimile.
Figure 4:
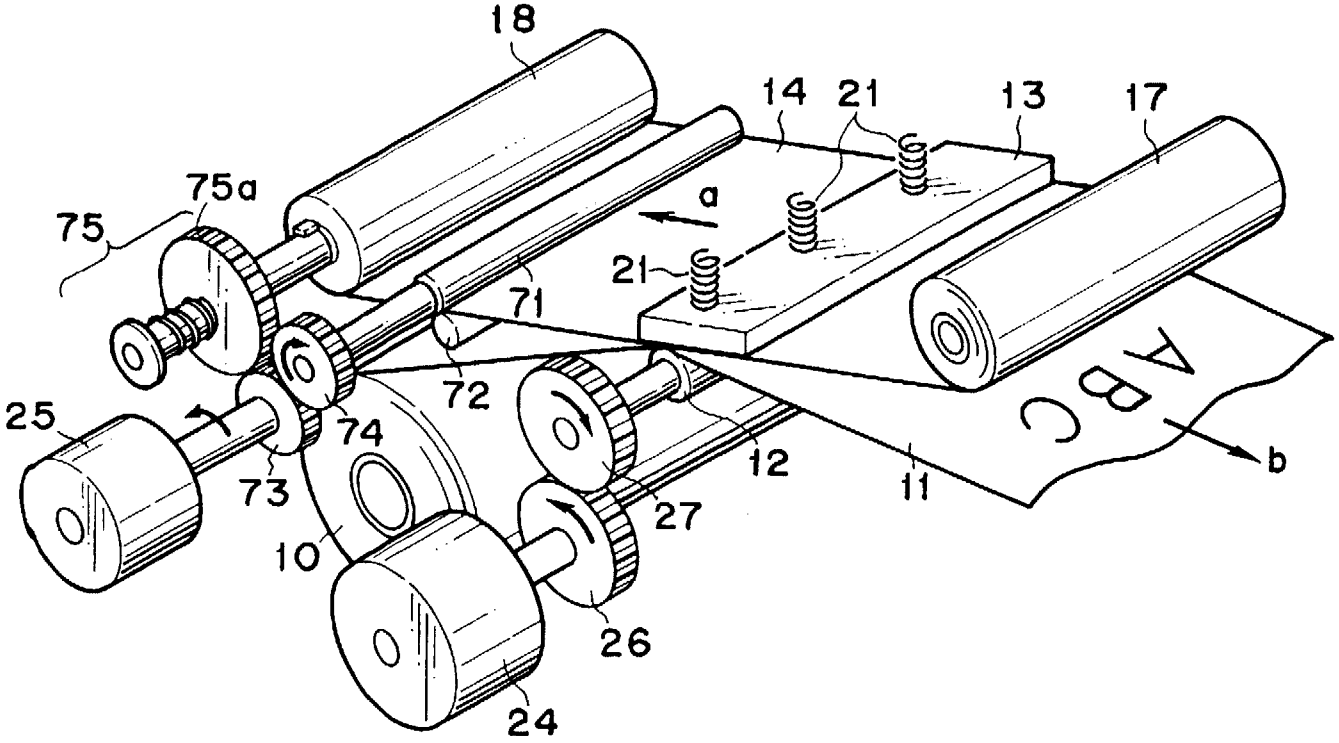
FIG. 4 is a drawing depicting the conveying system of ink sheet and recording sheet.
Figure 5:
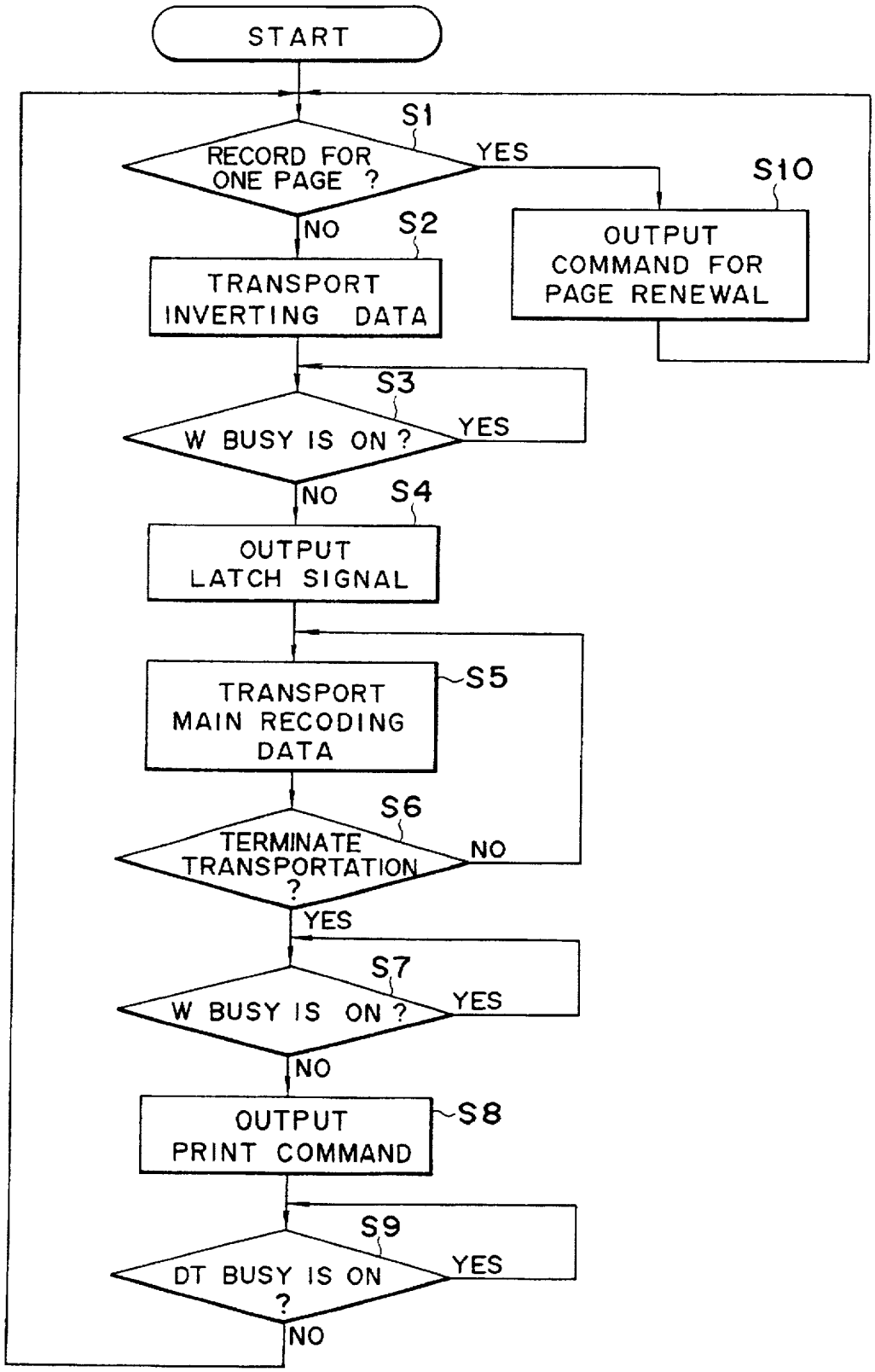
FIG. 5 is a flow chart showing processing steps of the CPU 113 of the aforesaid embodiment.

FIGS. 1–4 are drawings that show the example where a thermal transfer printer using an embodiment of the present invention is incorporated in a facsimile. FIG. 1 is the drawing that shows the electric connections of the control unit 101 and recording unit 102 of facsimile; FIG. 2 is the block diagram that shows the outline of the composition of the facsimile; FIG. 3A is the side sectional view of facsimile; FIG. 3B is the external diagonal view of the aforesaid facsimile and FIG. 4 is the drawing showing the conveying mechanism of the recording sheet and ink sheet.

In reference to FIG. 2, the outline of the composition of facsimile is now explained.

In FIG. 2, 100 is the reading unit to read the manuscript and output the digital image signal to the control unit 101 which is provided with the motor to convey the manuscript, and CCD image sensor, etc. Next the composition of this control unit 101 is explained. 110 is the line memory to store each line of the image data, which stores, at the time of transmission or copying of the manuscript, the image data of one line sent from the reading unit 100 and at the time of receiving of image data, it stores the decoded image data for one line received.

An image is formed when the stored data are output at recording unit 102. 111 is the encoding/decoding unit which encodes the image information to be transmitted by MH encoding and decodes the received encoded image data to convert the data into image data. 112 is the buffer memory that stores the encoded image data to be transmitted or received. The sections of the control unit 101 are individually controlled, for example by microprocessor CPU 113 etc. The control unit 101 is provided, other than CPU 113, with ROM 114 which memorizes the control program of CPU 113 and various other data and RAM 115 which temporarily preserves various data as the work area of CPU 113.

102 is the recording unit which is provided with a thermal line head and which executes recording of image on the recording sheet by thermal transfer recording method. Its composition shall be stated in detail with reference to FIG. 3. 103 is the operating unit which includes the keys to instruct various functions such as start of transmission, telephone number input keys etc; 103*a* is the switch that selects the kind of ink sheet 14 to be used, and also indicates that the multi-print ink sheet is mounted when switch 103*a* is turned ON and the ordinary ink sheet (the so-called one-time ink sheet) is mounted when it is OFF. 104 is usually installed adjacent to the operating unit. 103 is the indicating unit that indicates the state of various functions and the apparatus. 105 is the power source that supplies power to the entire apparatus. 106 is the modem (modulator/demodulator); 107 is the net control unit (NCU) and 108 is the telephone set.

Next, with reference to FIG. 3, the composition of the recording unit 102 is explained in detail. The parts corresponding to those of FIG. 2 are indicated with the same numbers.

In FIG. 3, 10 is the rolled sheet composed of the recording sheet 11, which is an ordinary sheet, rolled around the core 10*a*. This rolled sheet 10 is housed in the apparatus in such a way that it can rotate freely so that it can feed the recording sheet 11 to the thermal head 13 according to the rotation of platen roller 12 in the direction of arrow. 10*b* is the rolled sheet mounting unit on which rolled sheet 10 is mounted in a way allowing ON and OFF mounting and demounting. 12 is the platen roller which conveys the recording sheet 11 in the direction of arrow b and presses the ink sheet 14 and recording sheet 11 between the roller and the heat generating member 132 of thermal head 13. The recording sheet 11 on which the image is recorded by heating of thermal head 13 is conveyed toward the exhaust rollers 16 (16*a* and 16*b*) by the further rotation of platen roller 12 and when image recording for one page terminates, it is cut to single page lengths by the gearing of the cutter 15 (15*a* and 15*b*) and is then discharged.

17 is the ink sheet feed roll on which ink sheet 14 is coiled; 18 is the ink sheet winding roll which is driven by the ink sheet conveying motor to be described later and which winds the ink sheet 14 in the direction of arrow a. This ink sheet feed roll 17 and ink sheet wind up roll 18 are mounted on the ink sheet mounting unit 70 in the main body of the apparatus in such a way that it can be mounted on and off. 19 is the sensor to detect the remaining amount of the ink sheet 14 and the conveying speed of ink sheet 14. 20 is the ink sheet sensor to detect the presence or absence of ink sheet 14; 21 is the spring which presses the thermal head 13 against the platen roller 12 along with recording sheet 11 or ink sheet 14. 22 is the recording sheet sensor which detects whether the recording sheet is present or not.

Next the composition of reading unit 100 is explained.

In FIG. 3, 30 is the light source to irradiate the manuscript 32, the light reflected by the manuscript 32 being input into CCD sensor 31 via the optical system (mirror 50, 51 and lens 52) to be converted into electric signal. Manuscript 32 is conveyed by the conveying roller 53, 54, 55 and 56 which are driven by the manuscript conveying motor (not shown), in correspondence with the speed of reading manuscript 32. 57 is the table to hold the manuscript; plural sheets 32 placed on such table 57 are separated sheet by sheet by the coordinated motion of conveying roller 54 and pressure separating piece 58 while being guided by slider 57*a*, and each sheet of the manuscript is conveyed to the reading unit 100 and after reading discharged into the tray 77.

41 is the control baseboard which constitutes the recording control unit in the main section of the control unit 101 and recording unit 102, and various control signals are output from this control baseboard 41 to each part of the apparatus. 106 is the modem baseboard unit and 107 is the NCU baseboard unit.

FIG. 4 is the drawing to showing the details of the conveying system of the ink sheet 14 and recording sheet 11.

In FIG. 4, 24 is the motor for conveying recording sheets which drives and rotates the platen roller 12 and conveys the recording sheet 11 in the direction of arrow b which is in the direction opposite to the direction of arrow a. 25 is the motor for conveying ink sheets which conveys the ink sheet 14 in the direction of arrow a by capstan roller 71 and pinch roller 72. Further, 26 and 27 are transmission gears that transmit the rotation of the motor for conveying recording sheets to platen roller 12, while 73 and 74 are transmission gears that to transmit the rotation of the motor for conveying ink sheets to capstan roller 71. 75 is a sliding clutch unit.

Here, by setting the gears ratio of gear 74 and 75 in such way that the length of ink sheet 14 wound up by the winding roll 18 according to the rotation of gear 75*a* becomes somewhat longer than the length of the ink sheet conveyed by the capstan roller 71, so that the ink sheet 14 conveyed by capstan roller 71 is wound up on the wind-up roll 18 with certainty. The amount corresponding to the difference between the amount of ink sheet 14 wound on the wind-up roll 18 and the amount delivered from the capstan roller 71 is absorbed by the sliding clutch unit 75. In this way it is possible to reduce fluctuations in conveying speed (amount) of ink sheet 14 caused by fluctuations of winding diameters of wind-up roll 18.

As stated above, by reversing the conveying direction of recording sheet 11 and ink sheet 14, the direction in which the image is recorded on the recording sheet 11 in longitudinal direction (direction of arrow a) agrees with the conveying direction of ink sheet 14. When the conveying speed of recording sheet 11 is Vp and $Vp=-n\cdot V_I$($V_I$ is the conveying speed of ink sheet 14 and "11—11" indicates that the conveying direction of recording sheet 11 is opposite to the conveying direction of ink sheet 14), the relative speed $Vp_f$ of recording sheet 11 and ink sheet 14 as against the thermal head 13 is, $$Vp_f=V_p-V_f=(1+1/n)\ Vp$$

and it is known therefrom that such relative speed $Vp_f$ is larger than Vp or the relative speed of the two in the conventional system (the relative speed in the conventional system is $VP_f=Vp-V_f=Vp-Vp/n=(1-1/n)\ Vp$).

Beside the above there is such method as to convey the ink sheet 14 for l/m line for every (n/m) line (m is an integral number and n>m) in the direction of an arrow a for recording of image of n line by thermal head 13 or such method as to convey ink sheet 14 at the same speed as the recording sheet 11 but in the direction opposite to the direction of its motion during recording and prior to the recording of predetermined amount, the ink sheet is rewound for the length of L·(n−1)/n (where n>1) for recording of the length L. In either of the above cases, the relative speed of recording while keeping the ink sheet 14 standstill becomes Vp and the recording speed while keeping the ink sheet 14 moving becomes 2 Vp.

FIG. 1 indicates the connection of control unit 101 and recording unit 102 of the facsimile of the present embodiment, wherein the parts corresponding to those in the other drawings are given the same numbers.

The recording unit 102 of the present embodiment is provided with the recording control unit 201 (hereafter simply called UPi) which controls the entirety of recording unit 102. It reduces the work load of recording and processing of the control unit 101 (MPU 113 etc.) which is the core of the present apparatus. UPi201 is composed of the microprocessors which link the subsystem to MPU 113. Communication of various commands given by control unit 101 to various commands of UPi201 and output of various status information from UPi201 to control unit 101 are executed through the data line 202.

Thermal head 13 of the present embodiment is a line head (being provided with heat generating apparatus for the entire recording width). The thermal head 13 is provided with the serial recording data for one line supplied by control section 101 (to be delivered through data line 200), shift register 130 to input the shift clock 43, latch circuit 131 to latch the data of shift register 130 and heat generating apparatus 132 composed of head generating resistance for one line. Latch signal 44 can also be output from Upi201. Heat generating resistance 132 is driven by being divided into m pieces of blocks represented by 132-1~132-m. 133 is a temperature sensor attached to the thermal head 13 and it detects the temperature of thermal head 13. Output signal 42 of temperature sensor 133 is A/D converted in UPi201 and input into CPU 113 in the control unit 101. Thereby CPU 113 detects the temperature of thermal head 13 and according to the detected temperature, it changes the instruction of pulse width of strobe signal 47 or instructs a change of driving voltage of thermal head 13 so that the energy impressed on the thermal head 13 is changed according to the characteristics of ink sheet 14. 116 is the programmable timer on which programmed time is set and it starts counting time when time counting is instructed. At each instructed time point, it outputs interrupt/signal, time-out signal etc.

It may be so arranged that the kind (characteristics) of ink sheet 14 is instructed by the manual operation of switch 103*a* of operating unit 103 stated above or automatically judged by detecting the mark printed on the ink sheet 14. Alternatively it may be so arranged that the kind of ink sheet 14 is automatically judged by detecting the mark, notch or projection provided to the cartridge. 46 is the driving circuit that outputs the strobe signal 47 to drive the thermal head 13 block by block by feeding the driving signal of thermal head 13 from UPi201. This driving circuit 46 can change the energy impressed on the thermal head 13 by changing the voltage output on the source line 45 which feeds current to the heat generating apparatus 132 of thermal head 13 according to the instruction of UPi201. 36 is the driving circuit to cause gearing operation of cutter 13 and it controls the cutter driving motor etc. 39 is the sheet exhaust motor to drive the sheet exhaust roller 16. 35, 31 and 32 are the driver circuits to drive and rotate the corresponding sheet exhaust motor 39, recording sheet conveying motor 24 and ink sheet conveying motor 25. The sheet exhaust motor 39, recording sheet conveying motor 24 and ink sheet conveying motor 25 are all stepping motors in this embodiment but they are not limited thereto. For example DC motors may also be used instead.

[Explanation of recording action (FIGS. 1~8)]

The aforesaid composition eliminates the lack or fading of darkness which occurs when the dot is white (no recording i.e., the corresponding heat generating apparatus does not heat up) in the recording of the immediately preceding line while the dot is black in the present recording (recording is made i.e., the corresponding heat generating apparatus is energized). Such lack of darkness is caused by cooling of ink sheet 14 (including the heat generating resistance 132). Therefore in the present embodiment, the ink sheet is preheated to the appropriate temperature (the temperature at which ink melts) where the heat generating resistance 132 does not actually conduct recording based on the line recorded in the immediately preceding recording. To be more specific, the heat generating resistance which recorded a white dot in the immediately preceding recording is energized for preheating.

The heat generating resistance which recorded a black dot in the recording of the immediately preceding line and the ink sheet contacting such resistance are not preheated as they are considered to be at a sufficiently high temperature.

It is known therefrom that what is necessary here is to invert the line data used in the preceding recording and based on such inverted data, preheat the heat generating resistor. However, a dot should not actually be recorded by such preheating and therefore the strobe width is narrowed so that the energy should be reduced to the level below those supplied for ordinary line recording. In the present embodiment, the heating time of the thermal head for recording is set at 0.6 ms per block and that for preheating is set at around 0.2~0.3 ms.

Inverted data and main recording data are all output by the control unit 101 but inverted data can be prepared easily, if they are transferred via the inverter. It may also be produced by using software. Therefore, the detailed explanation of such method shall be omitted here.

The explanation goes back a little but there exist "W Busy (Write busy)" line and "DT Busy (Data Transfer busy)" line in the status control line which are output by UPi201 to the control unit 101 and they are so arranged that their signals are output at the control unit 101 when the corresponding flag is set during its processing by UPi201. Based on these two status signals, the control unit 101 determines the timing of transfer of inverted data and main recording data. In between the control unit and UPi201 exists a line to deliver the print command to instruct recording of one line.

The signal "DT Busy" indicates that when this signal is ON, the shift register 130 is still occupied and therefore transfer of succeeding data is prohibited. When "W Busy" is ON, it means that recording of one line of main recording data is proceeding and latching of main recording data of the succeeding line is impossible.

Figure 7:
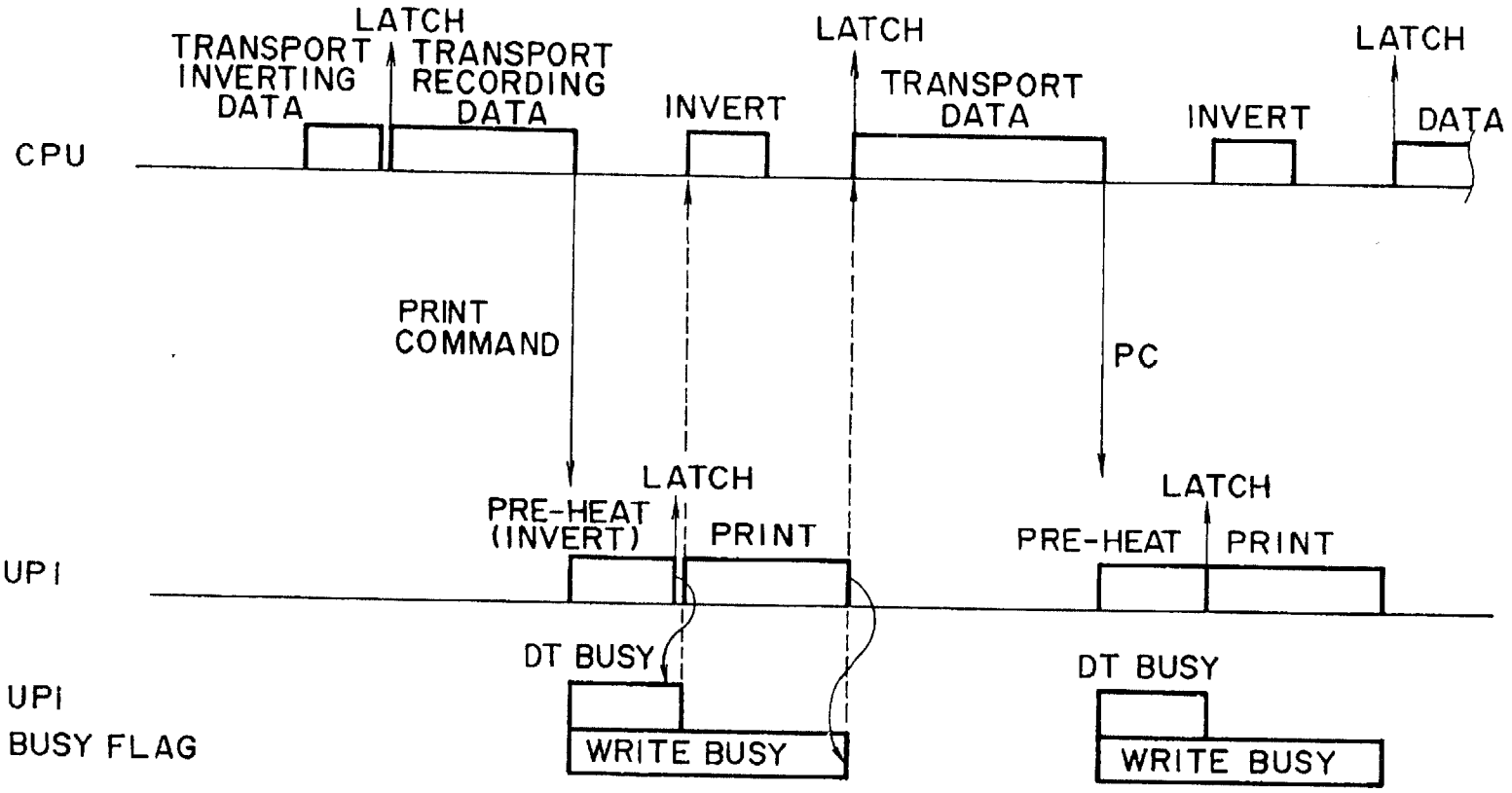
FIG. 7 is a drawing showing the timing of action of CPU 113 and the recording control unit.

The outline of the performance of CPU 113 and UPi201 in the control unit 101 based on the aforesaid principle is explained in reference to the timing chart of FIG. 7.

First CPU 113 transfers the inverted data of the line recorded immediately preceding to the shift register 130 via line 200 while synchronizing such data with shift clock 43. Thereafter by outputting the latch signal, it causes the latch circuit 131 to latch the inverted data stored in shift register 130. After having it latched, it transfers the main recording data by the same procedure, because the shift register 130 is in an empty state. When transfer of the main recording data terminates, print command of UPi201 is given.

When UPi201 receives this print command, it turns ON "DT Busy" and "W Busy" to prevent the delivery of the succeeding data. Thereafter, based on the inverted data supplied by the latch circuit 131 to heat generating resistance 132, each block is energized for time $t_0$ for preheating. When such preheating is over, latch signal 44 is emitted to latch the data of shift register 130 (main recording data) at latch circuit 131 and "DT Busy" is turned OFF (thereby CPU 113 transfers the inverted data of the recorded line). Then the aforesaid UPi201 conveys the recording sheet 11 for one line in preparation for main recording and conveys the ink sheet by 1/n line. Then based on the main recording data latched at the latch circuit 131, each block is energized for time $t_1(>t_0)$ which is the energizing time for ordinary recording to perform line recording. Then "W Busy" is turned OFF to get ready for accepting the delivery of the succeeding main recording data. The above steps are repeated one after another.

When the main recording data are the data at the head line of the page, the line immediately before that is regarded to be entirely white dots and thus black data are transferred to recording unit 102. Next the procedure of processing action of CPU113 of the aforesaid control unit 101 are explained in reference to the flow chart of FIG. 5. The control program to execute such processing is memorized in ROM 114 of control unit 101.

The processing starts when the image data for one line to be recorded are stored in the line memory 110 and the system becomes ready for starting recording action and mounting of multi-ink sheet 14 is judged by switch 103*a* etc. at the control unit 101.

At step S1, whether the transfer of data for one page has terminated or not is judged. When transfer of data for one page is terminated, a command to that effect is output at the recording unit 102.

When the judgment of step S1 is "NO", it proceeds to step S2 and outputs serially the inverted data of the line data recorded immediately prior to it to the shift register 130. When transfer of one line ends, it checks "W Busy" line of status signal of UPi201 at step S3 and waits until "W Busy" becomes OFF. When it becomes OFF, the processing proceeds to step S4 and the inverted data of shift register 103 is latched by the latch circuit 131. Thereafter the processing proceeds to step S5 and the main recording data are transferred to shift register 130. When it judges in step S6 that the transfer has finished, the processing proceeds to step S7 and it waits until "W Busy" turns OFF.

Then the processing proceeds to step S8 and the print command is given out to recording unit 102.

It then proceeds to step S9 and waits until "DT Busy" turns OFF. At steps S3, S7 and S9, while it is waiting until each signal turns OFF, CPU 113 can execute such processing as, for example, decoding of received image, or taking in of image data from reading unit 100.

Figure 6A:
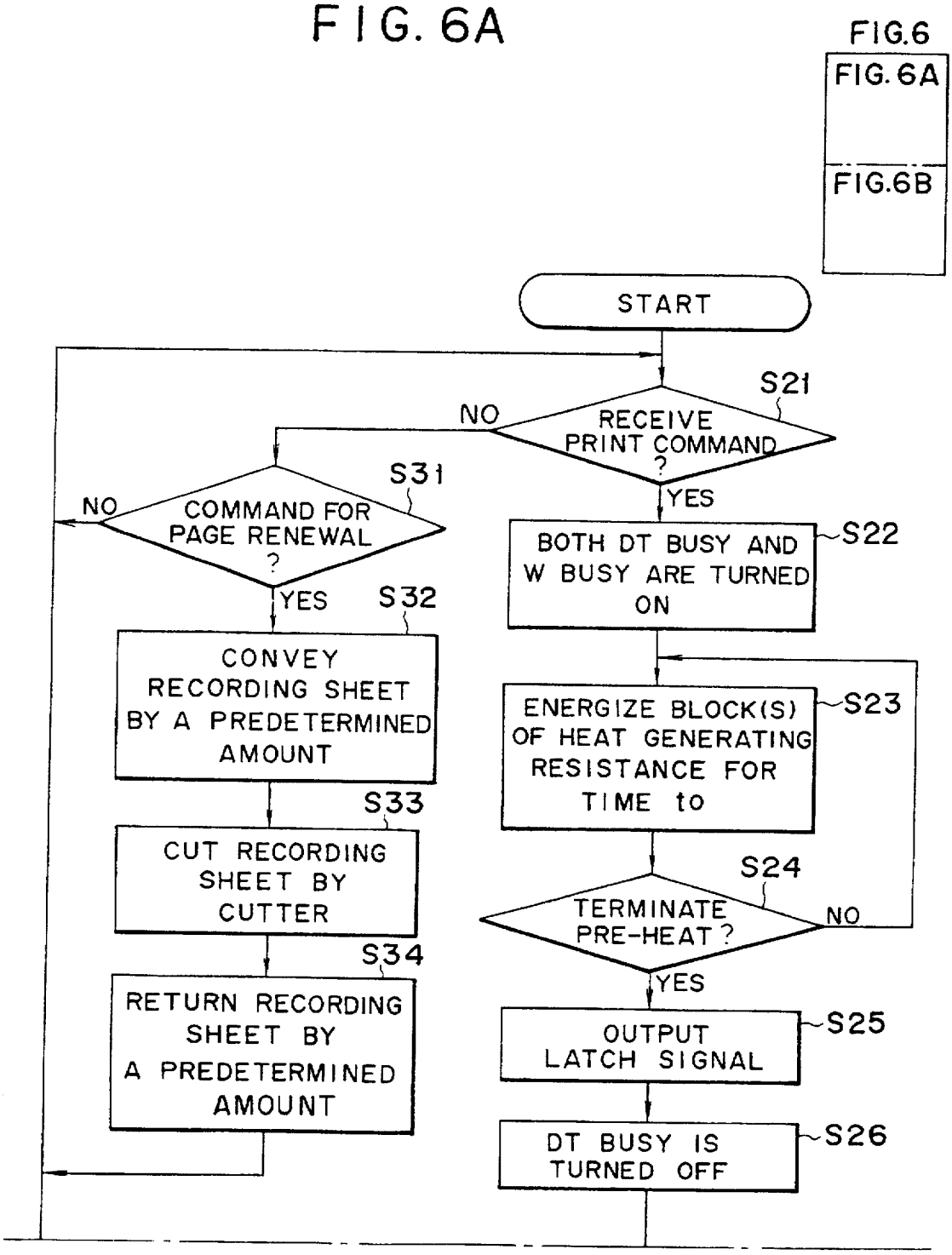
FIG. 6 is a flow chart showing the processing steps of the action of the recording control unit (UPi) of the aforesaid embodiment.
Figure 6B:
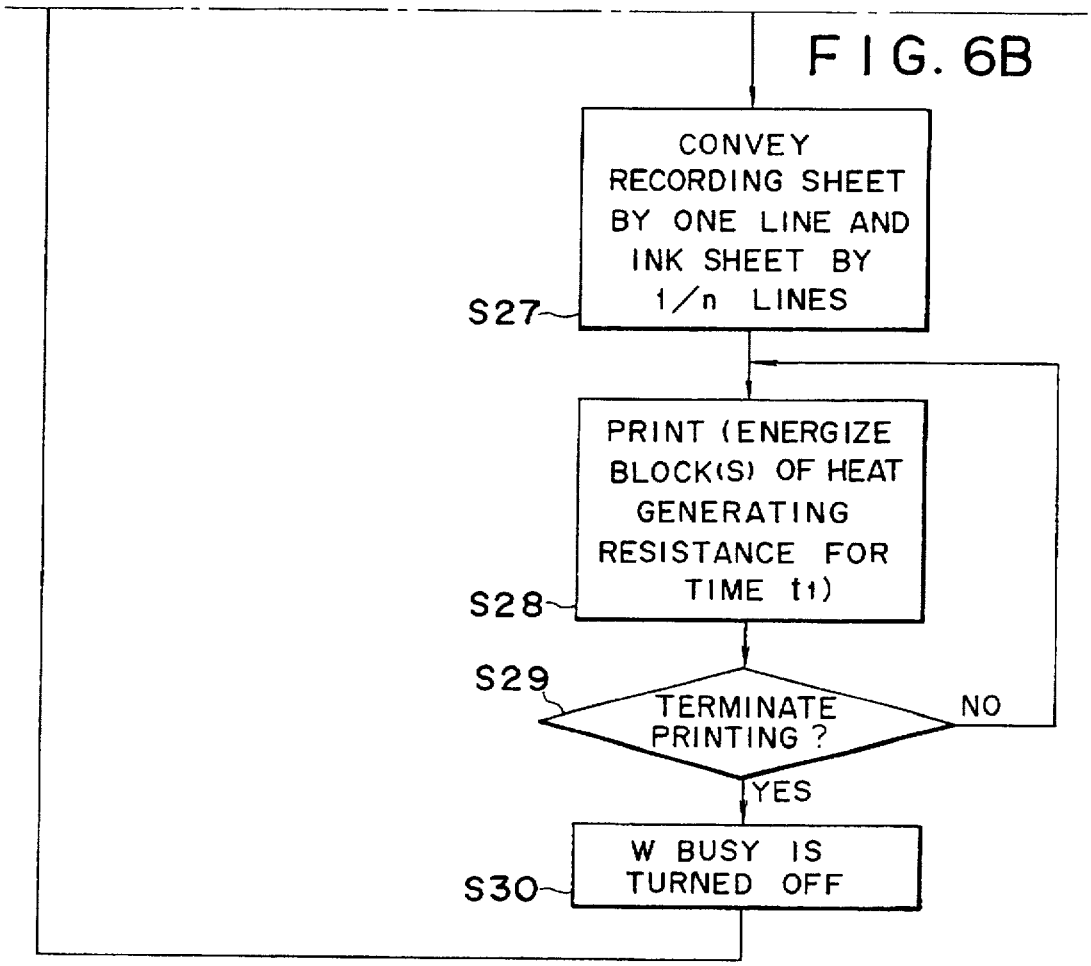

Steps of processing action of UPi201 in the recording unit 102 are explained with reference to the flow chart of FIG. 6.

First in Step 21, judgment is made whether print command has been received or not.

When it is judged that the command has been received, processing proceeds to step S22 and "DT Busy" and "W Busy" are both turned ON. At step 23, preheating is conducted by energizing the apparatuses which had received the signal "1" from latch circuit 131 of each block of heat generating resistance 132, for the duration of time $t_0$. Preheating is continued until preheating is judged to be complete for all blocks in step S24.

When preheating terminates, latch signal 44 is output and the main recording data are latched at the latch circuit 131. Thereby the shift register 130 becomes empty and therefore "DT Busy" is turned OFF to enable acceptance of inverted data (step S26). At step S27 driver circuits 48 and 49 are driven to convey recording sheet 11 for one line and ink sheet 14 for 1/n line. At step S28, the selected block of heat generating resistance 132 is energized for time $t_1(>t_0)$ to execute actual recording.

At step S29, processing made in step S28 is continued until it is judged that all blocks have been energized. When recording of one line is over, "W Busy" is turned OFF at step S30 to inform the control unit 101 that recording of the succeeding line is now possible.

On the other hand, at step S21, when it is so judged that the command other than the print command (page renewal command) has been received, processing proceeds from step S31 to step S32.

First at step S32, recording sheet 11 is conveyed in the direction of sheet exhaust rollers 16*a* and 16*b* for predetermined amount. At step S33, cutters 15*a* and 15*b* are driven for gearing and cut recording sheet 11 in page lengths. Then at step S34, recording sheet conveying motor 24 is driven in the reverse direction and returns the recording sheet 11 for the distance corresponding to the space between the thermal head 11 and cutter 15.

As aforesaid, according to the present embodiment, heat generating apparatuses of heat generating resistance which were white dots are preheated immediately prior to main recording and therefore there is no change to cause the shade of the black dot become weak.

Sticking of recording sheet 11 and ink sheet 14 which often occurs with thermal transfer apparatus, is eased reduced by preheating as practiced in the present embodiment.

Figure 8A:
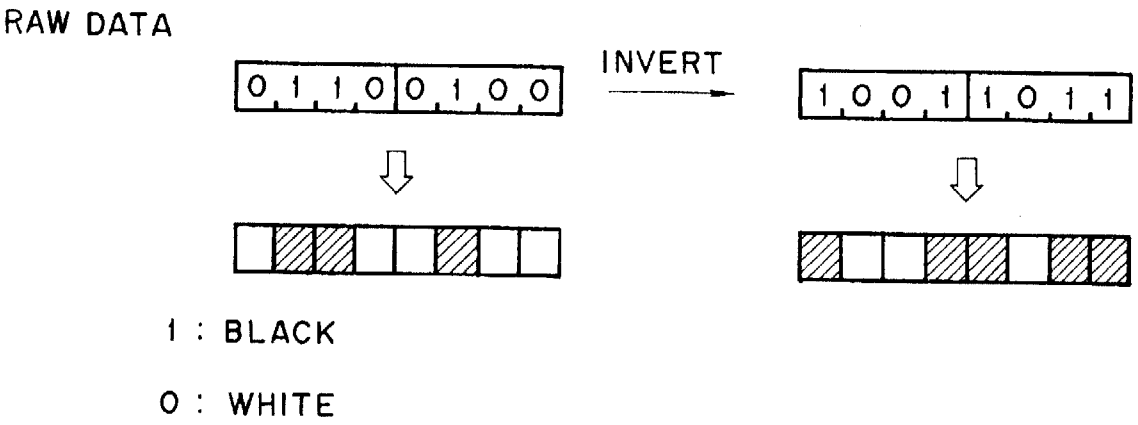
FIGS. 8A and 8B are drawings that explain the method of producing inverted data.
Figure 8B:
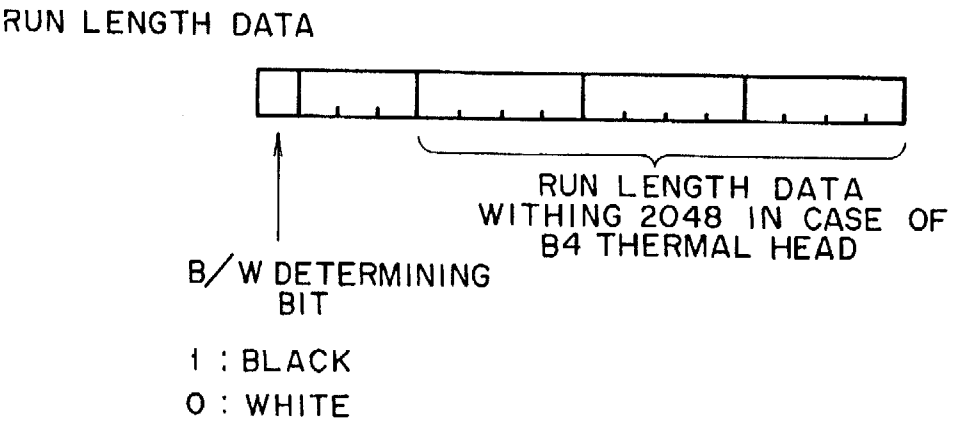

As for the method of preparation of inverted data, as shown in FIG. 8A, at copy mode or at the time of G2 signal reception, raw data may be used and exclusive OR may be taken with the command for inversion at 1 byte unit or FFH (H indicates the hexadecimal number).

At the time of ordinary signal reception, Run Length data are used. In the case of 2 byte unit and B4 thermal head is used, the data length is shown by the lower 12 bits and black or white is determined by the upper most one bit (see FIG. 8B). Therefore at the time of inversion, the upper most bit is inverted and decoded.

[Explanation of recording principle (FIG. 9)]

Figure 9:
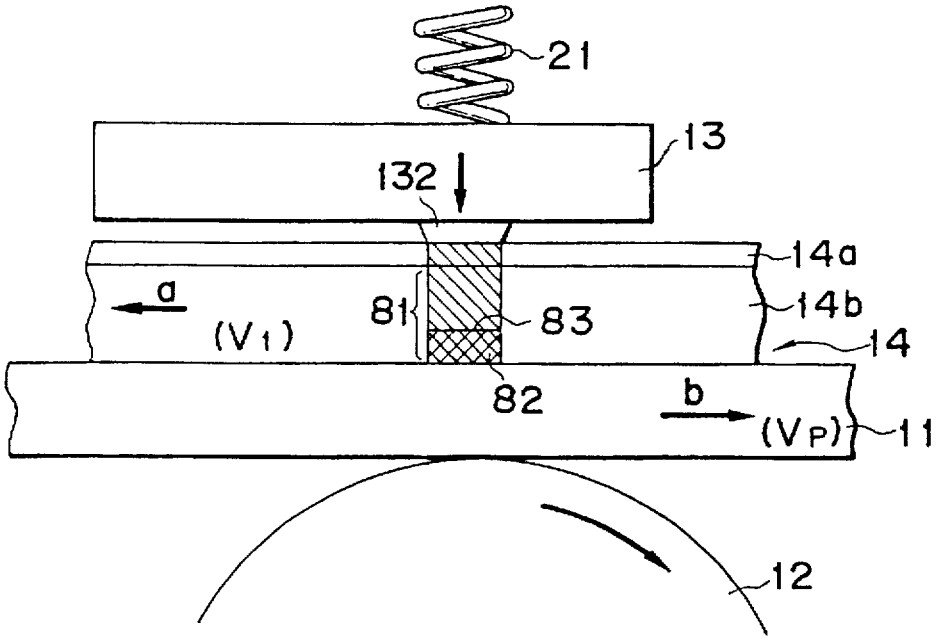
FIG. 9 is a drawing showing the state of the recording sheet and ink sheet at the time of recording according to the present embodiment.

FIG. 9 shows the state of image recording when an image is recorded by inverting the direction of conveying of recording sheet 11 and ink sheet 14 using the device of the present embodiment.

At shown in the drawing, recording sheet 11 and ink sheet 14 are sandwiched between the platen roller 12 and thermal head 13 and thermal head 13 is pressed against the platen roller 12 by the spring 21 with a preset pressure. Here the recording sheet 11 is conveyed in the direction of arrow b by the rotation of platen roller 12 at speed Vp. On the other hand, ink sheet 14 is conveyed in the direction of arrow a at speed $V_I$ by the rotation of motor 25 for conveying of ink sheet.

When the heat generating resistance 132 of thermal head 13 is heated by being energized by power source 105, the part 91 indicated by diagonal lines of ink sheet 14 is heated.

Here 14*a* is the base film of ink sheet 14 and 14*b* is the ink layer of ink sheet 14. By energizing the heat generating resistance 132, the ink of the heated ink layer 91 melts and the part indicated by 92 is transferred to recording sheet 11. The part of transferred ink layer 92 corresponds to about 1/n of the entire ink layer.

At the time of transfer, it is necessary to apply a shearing force to ink at the border 93 of ink layer 146 and transfer the part indicated by 92 to the recording sheet 11. However, such shearing force varies according to the temperature of ink layer, and the higher the temperature of the ink layer, the smaller need be the shearing force. Therefore when the heating time of ink sheet 14 is shortened, the shearing force in the ink layer becomes large and therefore when the relative speed of ink sheet 14 and recording sheet 11 is made sufficiently large, it is possible to peel off the ink layer to be transferred from ink sheet 14.

[Explanation of ink sheet (FIG. 10)]

Figure 10:
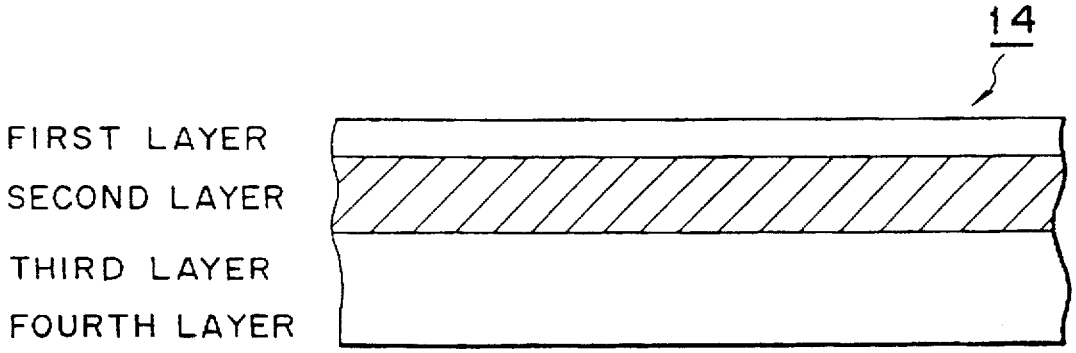
FIG. 10 is a sectional view of the multi-ink sheet used in the present embodiment.

FIG. 10 shows a sectional view of the ink sheet to be used for multi-print of the present embodiment. It is composed of 4 layers.

The second layer is the base film which supports the ink sheet 14. In the case of multi-print, since heat energy is repeatedly applied to the same spot, aromatic polyamide film or condenser sheet which have high heat resistance, are suitable but conventional polyester film will also do it is used as a medium. The thinner these films, the better will be the quality of prints but in view of the requirement of strength, the thickness of 3–8 μm is preferred.

The third layer is an ink layer which contains the amount of ink sufficient for making n times of transfer print on the recording sheet. This ink layer is mainly composed of EVA or other resins used for adhesive, carbon black or nigrosine dyes used for coloring, carnauba wax or paraffin wax used for binder etc. so that it withstands n times of use on the same spot. The preferred amount of coating is 4–8 g/m$^2$ but it may be freely selected because the frequency of print and darkness of printed color vary according to the amount of coating.

The fourth layer is the part not printed, which is the top-coating layer and prevents transfer by pressure of the ink of the third layer on the recording sheet and it is composed of transparent wax etc. By the effect of this layer, only the transparent fourth layer is transferred by pressure and the staining of the recording sheet is prevented. The first layer is a heat resistant coating to protect the second layer base film. It is suitable for the multi-print system wherein thermal energy could be impressed for n lines on the same spot (when black information continues) but whether to use it or not is the choice of the user.

It is effective particularly for a base film with relatively low heat resistance such as polyester film.

The composition of ink sheet 14 is not limited to the present embodiment and, for example, it may be composed of the base layer and the ink holding porous layer to contain ink provided at the side of the base layer or it may be so constructed that a heat resistant ink layer having a fine porous net structure is provided on the base film and ink is impregnated into such ink layer.

The material of construction of the base film may be the film composed of polyamide, polyethylene, polyester, PVC, triacetyl cellulose, nylon, etc. A heat resistant coating layer is not necessarily required but when used, it may be made of, for example, silicone resin, epoxy resin, fluororesin, etholocellulose, etc.

An example of an ink sheet having sublimating property may be the one obtained by coating coloring layer composed of spacer granules comprising guanamine resin and fluororesin and dyestuff on the base film made of polyethylene telephthalate, polyethylene naphthalate, aromatic polyamide film etc.

Heating systems introduced in the aforesaid embodiment are not limited to the thermal head system but may be for example, an electrification system or laser transfer system.

In this embodiment, explanation was made for the case using a thermal line head but it is not limited thereto, and the so-called serial type thermal transfer printer may be used. In the present embodiment explanation was made for the case of multi-print system and it is not limited thereto but the present invention may be applied to the ordinary thermal transfer recording system where the so-called one-time ink sheet is used.

In the aforesaid embodiment, explanation was made for the case when the present invention is applied to a facsimile and it is not limited thereto but, for example, it may be applied to a thermal transfer printer, word processor, typewriter or copying machine.

The recording medium is not limited to recording sheets but it may be for example cloth, plastic sheet, etc. as far as it accepts transfer of ink. The ink sheet is not limited to the rolled sheet as shown in the embodiment but it may be the so-called ink sheet cassette type wherein an ink sheet is housed in a box which may be mounted on and off the main body of the recording apparatus and the box as a whole is mounted on and off the recording apparatus.

In the aforesaid embodiment, explanation was made on thermal head as an example of recording means but the present invention is not limited thereto. For example, an ink jet head wherein recording is made on the recording medium by jetting out the ink may be used (for example ink jet printer). Such ink jet head, generally speaking, is provided with a fine liquid discharge hole (orifice), liquid channel, energy action unit provided at a part of the liquid channel and energy generating means provided at the energy action unit to generate energy and form liquid drops to work on the liquid. The energy generating means to generate such energy may be such means that an electromagnetic wave source such as laser is irradiated and energy is absorbed by the liquid to generate heat and thus generated heat causes the liquid drop to jump out and be discharged or alternatively such means as to heat the liquid by electric heat converter and thereby cause the delivery of the liquid. Among them, what is particularly profitable is the bubble jet head wherein the driving signal is impressed on the thermoelectric converter rapid temperature increase, such increase going beyond the boiling point and thermal energy is generated by the thermoelectric converter, thereby causing membrane boiling at the working plane of the head to form air bubbles in the ink and by the growth of such air bubbles, ink is delivered through the delivery hole. With such a bubble jet head, the ink discharge holes may be arranged at high density and it is profitable for conducting recording at high resolution.

As explained above, according to the present embodiment, prior to recording of the line being attended, heat generating resistance 132 is preheated by the inverted data of the line recorded immediately before and thereby such trouble as the loss of darkness of the independent black dot is avoided and a favorable image can be reproduced.

In the foregoing example, explanation was made dividedly on the control unit 101 as the main control unit, recording control unit 201 as the sub-control unit but they may be of course be realized by one microprocessor.

As explained above, according to the present invention, the recording method and apparatus producing the image of improved quality are provided.

We claim:

1. An image communication apparatus for recording an image transmitted from another device on a recording medium by using a thermal head provided with a plurality of recording elements and having a recording width corresponding to one line of said image, said apparatus comprising:

receiving means for receiving a run-length coding data in accordance with an image transferred from the other device;

reading-out means for reading out a manuscript image;

decoding means for decoding the run-length coding data received by said receiving means;

driving means for recording an image at every line on a recording medium by driving the recording elements of said thermal head in accordance with data decoded by said decoding means in a facsimile mode and by driving the recording elements of said thermal head in accordance with data read out by the reading-out means in a copy mode;

preheat means for preheating by driving the recording elements of said thermal head by said driving means in accordance with inverted data of a previous line before recording a present line; and producing means for producing the inverted data for said preheating, wherein said producing means produces inverted data from raw data read out by said reading-out means in the copy mode, and produces inverted data by decoding data obtained by inverting an uppermost bit of said run-length coding data by said decoding means in the facsimile mode, and an amount of energy applied to said recording elements when preheating is smaller than an amount of energy applied to said recording elements when recording.

2. An image communication apparatus according to claim 1, wherein during preheating said driving means provides said recording elements with a pulse width of a driving signal which is smaller than a pulse width of a driving signal which is applied to said recording elements during the image recording.

* * * * *

UNITED STATES PATENT AND TRADEMARK OFFICE

CERTIFICATE OF CORRECTION

PATENT NO. : 5,798,789

DATED : August 25, 1998

INVENTOR(S) : Takeshi Ono, et al.

It is certified that error appears in the above-identified patent and that said Letters Patent is hereby corrected as shown below:

On the title page,

Item [57] ABSTRACT

Line 2, "the" (first occurrence) should read --a--; and "of the ink sheet on" should read --from an ink sheet to--.
Line 4, "the" (both occurrences) should be deleted;
Line 7, "the" should be deleted;
Line 8, "the energy smaller" should read --less energy--;
Line 9, "the" should be deleted;
Line 11, "providing such advantage as the" should read --offering such advantages as--;
Line 12, "saving of" should read --reduced--;
Line 13, "sheet" should read --sheets--; and "saving of running cost, etc." should read --reduction of running costs.--.

COLUMN 1

Line 13, "image" should read --images--;
Line 15, "Form" should read --forms--;
Line 27, "on" should read --to--;
Line 35, "certainly." should read --certainty.--;
Line 36, "of" should read --of a--.

UNITED STATES PATENT AND TRADEMARK OFFICE

CERTIFICATE OF CORRECTION

PATENT NO. : 5,798,789

DATED : August 25, 1998

INVENTOR(S) : Takeshi Ono, et al.

It is certified that error appears in the above-identified patent and that said Letters Patent is hereby corrected as shown below:

COLUMN 2

Line 20, "illustrate" should read --illustrates--;
Line 27, "facsimile" should read --facsimile apparatus--;
Line 34, "facsimile." should read --facsimile apparatus--.

COLUMN 3

Line 32, "the keys" should read --keys--;
Line 46, "FIG. 3" should read --FIGS. 3A and 3B--;
Line 50, "FIG. 3," should read --FIG. 3A,--;
Line 55, "arrow." should read --the arrow.--.

COLUMN 4

Line 16, "FIG. 3," should read --FIG. 3A,--;
Line 18, "mirror" should read --mirrors--;
Line 20, "roller" should read --rollers--;
Line 46, "to" should be deleted.
Line 48, "gears ratio of gear" should read --gear ratio of gears--;
Line 67, ""11-11"" should read --"-"--.

COLUMN 5

Line 13, "an" should be deleted;
Line 14, "image" should read --an image--;
Line 21, "14" should read --14 at a--;
Line 45, "head" should read --heat--.

UNITED STATES PATENT AND TRADEMARK OFFICE

CERTIFICATE OF CORRECTION

PATENT NO. : 5,798,789
DATED : August 25, 1998
INVENTOR(S) : Takeshi Ono, et al.

It is certified that error appears in the above-identified patent and that said Letters Patent is hereby corrected as shown below:

COLUMN 7

Line 8, "to" should be deleted;
Line 21, "emitted" should read --given--;
Line 38, "CPU113" should read --CPU 113--.

COLUMN 8

Line 46, "14" should read --14,--;
Line 47, "eased" should be deleted;
Line 56, "of" should read --that a--;
Line 58, "upper most" should read --uppermost--;
Line 59, "upper most" should read --uppermost--;
Line 66, "At" should read --As--.

COLUMN 9

Line 35, "sheet" should read --sheet,--.

UNITED STATES PATENT AND TRADEMARK OFFICE

CERTIFICATE OF CORRECTION

PATENT NO. : 5,798,789

DATED : August 25, 1998

INVENTOR(S) : Takeshi Ono, et al.

It is certified that error appears in the above-identified patent and that said Letters Patent is hereby corrected as shown below:

COLUMN 10

Line 7, "etholocellulose" should read --ethylcellulose--;
Line 12, "telephthalate" should read --terephthalate--;
Line 15, "but" should read --used, but--;
Line 57, "verter" should read --verter to cause a--.

Signed and Sealed this

Fourth Day of May, 1999

*Attest:*

Q. TODD DICKINSON

*Attesting Officer*

*Acting Commissioner of Patents and Trademarks*